US006164440A

United States Patent [19]

Van Bree

[11] Patent Number: 6,164,440

[45] Date of Patent: Dec. 26, 2000

[54] CONVEYOR FOR INDIVIDUAL UNITS

[75] Inventor: Theodorus J P M Van Bree, Westdorpe, Netherlands

[73] Assignee: Conteyor Multibag Systems N.V., Merelbeke, Belgium

[21] Appl. No.: 09/091,943

[22] PCT Filed: Dec. 24, 1996

[86] PCT No.: PCT/EP96/05838

§ 371 Date: Oct. 19, 1998

§ 102(e) Date: Oct. 19, 1998

[87] PCT Pub. No.: WO97/24269

PCT Pub. Date: Jul. 10, 1997

[30] Foreign Application Priority Data

Dec. 29, 1995 [DE] Germany ..... 195 49 166

[51] Int. Cl.[7] ..... B65G 17/04

[52] U.S. Cl. ..... 198/867.11; 198/715; 198/803.14; 198/860.3

[58] Field of Search ..... 198/715, 867.11, 198/867.15, 803.13, 803.14, 860.3, 860.4, 860.5

[56] References Cited

U.S. PATENT DOCUMENTS

| | | | |
|---|---|---|---|
| 1,389,995 | 9/1921 | Schutt | 198/715 |
| 2,249,588 | 7/1941 | Waddle | 198/860.4 |
| 2,758,703 | 8/1956 | Hampf | 198/715 |
| 2,919,791 | 1/1960 | Hampf | 198/715 |
| 2,956,668 | 10/1960 | Fioravanti | 198/715 |
| 3,788,453 | 1/1974 | Varney | 198/715 |
| 4,093,066 | 6/1978 | Mitchell et al. | 198/860.4 |
| 4,730,721 | 3/1988 | Demaiter | 198/715 |
| 5,377,811 | 1/1995 | Tanaka | 198/715 |
| 5,947,266 | 9/1999 | Rionde | 198/860.3 |

FOREIGN PATENT DOCUMENTS

| | | | |
|---|---|---|---|
| 22602 | 1/1981 | European Pat. Off. | 198/715 |
| 4138507 | 11/1991 | Germany . | |

*Primary Examiner*—Douglas Hess
*Attorney, Agent, or Firm*—Michael L. Dunn

[57] ABSTRACT

The invention relates to a conveyor for individual units which comprises a frame (1) with an upper guide for at least a first rod (2) conveyed and held on said guide and with further rods (3) which also extend on the upper guide or a guide parallel thereto at a distance below the upper guide substantially parallel to the first rod (2). Strip material (4) mounted on the rods forms, between the rods (2, 3) held in the guides, loops which act as receiving pockets (5) for individual units (6). To create a conveyor with the above features which provides the items to be transported with improved protection from damage without affecting the capacity for rapid loading and unloading and for reuse, the invention proposes at least one support rod (7) which can be moved below the upper guide to be aligned parallel to the other rods (2, 3) and in the direction of the receiving pockets (5) or the individual units (6) held therein and which is in contact with the last of said pockets (5) or the item (6) held therein, and can be fixed in said position of rest.

30 Claims, 7 Drawing Sheets

CONVEYOR FOR INDIVIDUAL UNITS

Figure 1:
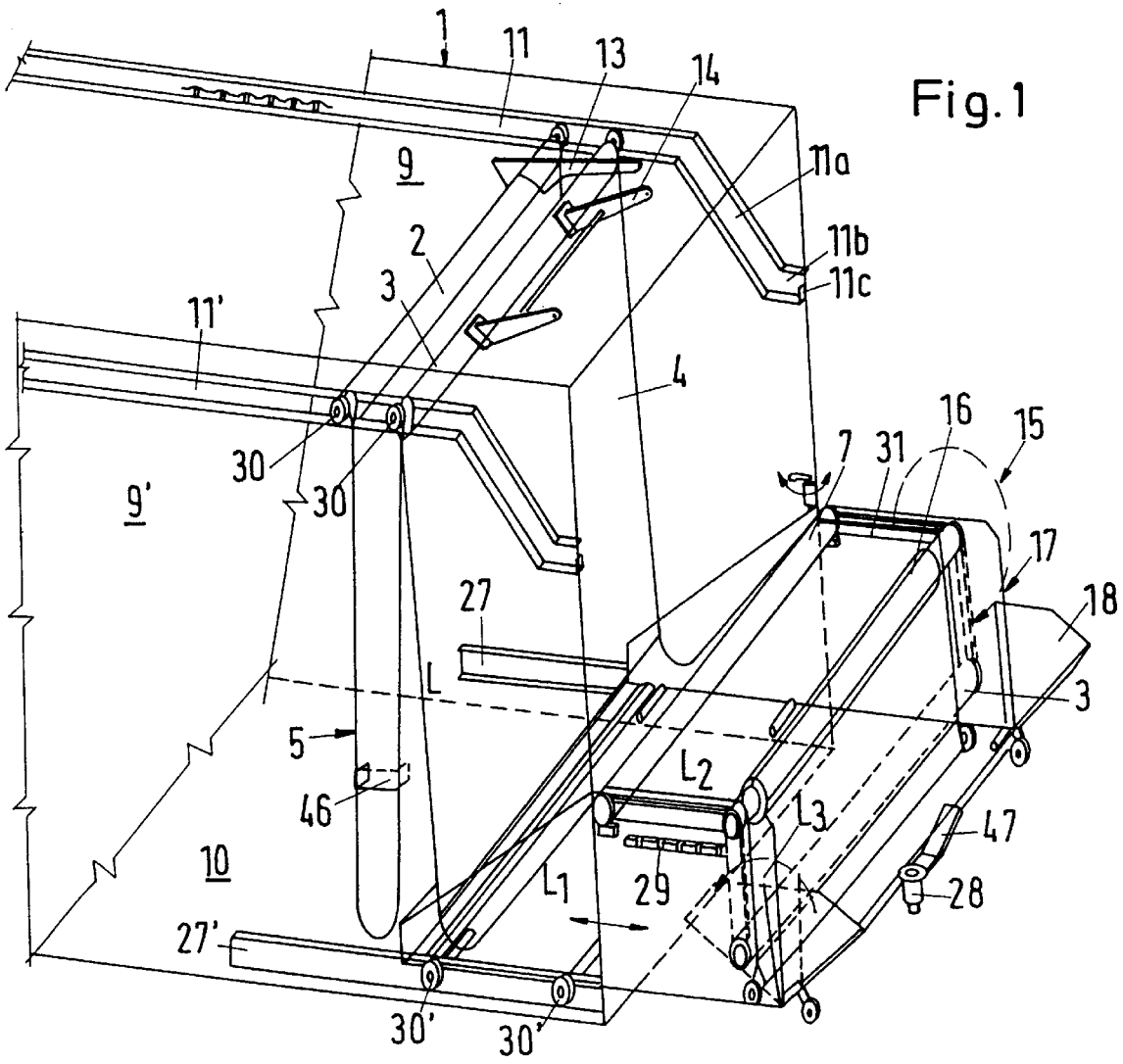

The present invention relates to a transportation device for piece goods, consisting of a frame with an upper guide for at least a first rod held and guided on this guide and with further rods which likewise extend on the upper guide or on a guide parallel hereto at a distance beneath the upper guide substantially parallel to the first rod, wherein the rods carry a web material which between the rods held in the guides forms loops as receiving pockets for piece goods.

Such a device is known from the German Patent Application No. P 41 38 507.1.

To explain the terms used within the framework of the present application, it is additionaly pointed out that, in a similar manner also in the case of the above-mentioned application, the term "frame" is to be understood very broadly and includes all kinds of open and closed supports or frames, including closed boxes or cases which only consist of side walls and base and/or cover. The terms "frame" and "container" are therefore used largely synonymously in the present application. In addition, the term "web material" is also formulated very broadly and includes foils as well as fabrics, nets and individual strips, arranged parallel adjacent to each other, of foil- or fabric material or of cords. The web material is respectively suspended on two adjacent rods and hangs downwards between these two rods in the form of a loop, forming a receiving pocket. On the end face, these pockets or loops can be open or closed, e.g. they can also be closable by means of an—optionally elastic—band, so that the two opposing parts of a pocket are held together at the end faces. The web material can extend optionally only between two respectively adjacent rods, so that respectively two rods with the pocket situated therebetween are independent of the remaining pockets, preferably however the web extends over more than two rods, so that a series of cohesive loops or pockets is formed.

Such transportation devices are primarily intended for the transportation of piece goods, in particular for the transportation of respectively similar piece goods which are required as finished pieces or as components or semifinished pieces for the production and assembly of more complex objects. An example of this is body parts in the automobile indutry which, for example, are punched and formed in a body factory a distance away from the assembly factory for the cars and only then have to be transported to the assembly site. Many piece goods are sensitive to scratching, shocks or impacts, because they can hereby be either destroyed, damaged or deformed or else at least become unsightly. They are then possibly unusable for the further processing- or manufacturing process.

The concern with such piece goods is therefore that a corresponding transportation device protects the individual objects reliably from such damage.

Furthermore, in the case of piece goods which are produced for further processing or assembly, the loading- and unloading process must be simplified and accelerated as much as possible. In actual terms, as far as possible not every individual piece has to be packed in its own container with corresponding padding material and the container then also further closed, because packing into such containers and the subsequent removal is extremely time-consuming and makes the production process considerably more expensive, to which the packing material, which under certain circumstances is extremely expensive, contributes. In this respect, devices are preferred which can be reused more or less completely and unchanged.

The device known from the prior art according to P 41 38 507.1 which refers back to the applicant's legal predecessor, already satisfactorily fulfils a part of the above-mentioned requirements. In so far as details within the framework of the present application are not described precisely, in particular as regards the construction of the individual pockets and loops and also their suspension on the rods, then reference is to be made to the above-mentioned application, the features of which in this respect are also deemed to be disclosed for the present device.

Furthermore, it has been found, however, that in the known transportation device, occasional damage of individual parts can not be completely ruled out, in particular where very sensitive objects are concerned, e.g. painted sheet metal parts or objects of glass or of another material sensitive to impact, and when the transportation conditions are relatively rough, i.e. if lorries laden with such transportation devices travel for example at high speed through road holes or around tight bends.

On the other hand, the known device already fulfils essential requirements with regard to a quick loading- and unloading possibility and also with regard to the reusability, generally without expendable materials.

Compared with this prior art, therefore the present invention is based on the problem of providing a transportation device with the features mentioned in the introduction, which protects the objects to be transported even better from damage, without the quick loading- and unloading possibility and the reusability being impaired.

This problem is solved in that at least one holding rod is provided, which is displaceable beneath the upper guide aligned parallel to the remaning rods and in the direction of the receiving pockets or the piece goods or objects held therein and in abutment to the last of these pockets or up to the last object held therein, and is fixable in this abutment position.

As one can easily imagine, the piece goods held in the pockets can have the most varied of shapes, wherein however the transportation arrangement is preferably used such that in a frame or container respectively a series of identical objects is held in the individual, successively arranged pockets. Of course, this does not rule out the fact that for example also different objects can be arranged alternately in the pockets, which complement each other in their shape so that the device is used in a more space-saving manner or that one and the same objects are loded alternately in differing orientation into the pockets.

Nevertheless, the pockets suspended in the containers or frames, with the objects situated therein, as a whole form a structure capable of oscillation and the individual pockets can easily go into oscillation in groups or reciprocally, so that either adjacent pockets hit each other or the pockets strike against the frame or the container walls or against adjacent containers of the objects held therein. In so doing, undesired damage can occur to the objects held in the individual pockets.

According to the invention, the capability of the individual pockets to oscillate is considerably reduced by the additional holding rod which is displaceable beneath the upper guide and aligned in parallel to the remaining rods in the direction of the respectively last of the pockets or the objects held therein and is fixable in abutment therein. If one imagines for example a series of 10–20 individual pockets, which are formed by web material hanging down in a loop form from a corresponding series of parallel rods and in which for example respectively the radiator cover of an automobile is held, then these pockets, suspended in a container or frame, can oscillate relatively strongly. If now, however, from one side in a container or frame a holding rod is pushed up to the respectively last of these pockets beneath the upper guide for the rods, then the individual pockets are pressed together in a central region and secured, so that they can practically no longer rock or oscillate. At the same time, the web material forms a padding between the individual objects and with sight displacements of the pockets to each other, prevents the objects from scratching each other.

In the case of other objects which can touch each other reciprocally, without the risk of damage thereby arising, the pockets can also be formed by very short loops in which only a lower part of the respective object is held. Only the first such pocket extends with one side to an upper guide or a rod, which is guided in such a guide and the following rods are arranged substantially lower and form only very short loops or pockets, from which the individual objects extend upwards. In this case, the holding rod, after the loading of the pockets with the individual objects is not pushed up to the pocket but rather to the last object, so that the objects themselves are pressed together and are largely fixed in the compressed position, so that an oscillation or rocking is scarcely still possible. In so doing, for example, a lower, somewhat more sensitive part of the objects can be held in the pockets, whilst the objects lie adjacent to each other in their upper region and in so doing are padded against each other possibly by padding material which can also be part of the objects. This variant can also be altered in that between every two adjacent objects a corresponding holding rod is arranged, which separates the objects from each other so that also sensitive objects can be transported in the short pockets.

An embodiment of the invention is preferred, in which the upper and the possibly present lower guide consist respectively of a pair of guide tracks arranged laterally in the frame. This gives the rods, which are then guided with their two opposed ends respectively on or in these guide tracks, a maximum stability for carrying the pockets.

Furthermore, it is expedient if the frame or container has a closure flap on its one side from which it is charged or loaded and unloaded with the respective objects. Optionally, such a closure flap can of course also be provided on the two opposite sides of a container or frame, so that optionally the unloading and loading can take place from one side just as from the other side. In the latter case, a further holding rod could also be provided, which can be pushed from the opposite side up to the pockets or the objects held therein.

To protect the objects held in the pockets, a device is preferred in which the frame is constructed with side walls and/or base and/or cover as a substantially closed container. As already mentioned, such a container can be produced so that on a bearing frame corresponding walls, base and cover are arranged, or else the walls of the container can also be self-supporting, so that the "frame" is formed by the walls and possibly base and cover itself. Corresponding guide tracks are then arranged for example directly on the walls of the container. Vice versa, also the guide tracks could be connected with each other into an open support or frame, and corresponding walls could then be arranged on this frame.

For many applications, it may be expedient if at least the holding rod(s) is(are) surrounded by a padding material. If necessary, this can also be expedient for the remaining rods which carry the pockets, in particular in the case of the rods only forming short loops or pockets, which are guided in a lower guide.

Furthermore, an embodiment of the invention is preferred, in which holding parts and stopping parts are provided for the holding or stopping of the rods in the guides in a loading- or unloading position of the respective rods. In this development, the concern is actually that the objects are removed individually and in succession from the pockets or are inserted into the pockets. For this, the respective pocket is to be easily accessible in a loading- or unloading position and is also to be fixed in this position, for which the above-mentioned holding- and stopping parts serve. Here, the rod of the respectively next pocket can also already be held or stopped in a preparation position.

An expedient development of the present invention is produced in that the holding rod is provided on a loading sliding carriage which is displaceable into the frame. This loading sliding carriage fulfils a dual function, by ensuring both the aligned guiding of the holding rod up to the respectively last pocket or respectively last object, at the same time however also serving as an auxiliary device which facilitates and accelerates the loading and unloading of the device. This loading sliding carriage, as already mentioned, is displaceable into the frame or container and can accordingly also be drawn out at least a little out from the frame. The drawn out position here is the unloading- or loading position and in the pushed-in position the holding rod, arranged on the loading sliding carriage, is pressed against the pockets or objects, it being understood that the sliding carriage is fixable in various pushed-in positions in the frame, so that the position of the holding rod can be varied accordingly, in order to obtain a secure abutment against the last pocket or against the last object.

For the unloading or loading, the loading sliding carriage has a loading rod arranged behind the holding rod, and in addition expediently under the holding rod and the loading rod a stowage box is provided to receive rods and the web material arranged thereon (the empty pockets). The loading sliding carriage is therefore actually constructed so that the holding rod and the loading rod are situated anywhere on a central level of the frame or container beneath the upper guides, so that therebeneath there is still space for a stowage box. The holding rod is arranged here on the side facing the objects or pockets in the container and the loading rod is situated behind it, i.e. on the side facing away from the pockets. With the sliding carriage drawn out, the holding rod could then for example either already be outside the frame or be situated approximately in the plane of the front edge of the container or frame. Then the respective rod is taken out on the end face from the guide from the last pocket against which the holding rod had previously been situated and which in the case of unloading is the first pocket to be unloaded, and the respective rod is then deposited over the sliding carriage downwards into the stowage box (open at the front). In so doing, the web which forms the one side of the pocket or loop firstly places itself over the holding rod and then over the loading rod, and the pocket is thereby largely open, wherein on the one side of the pocket only a short lower section of the pocket is still formed between the holding rod and the lowest point of the pocket. The object is then easily accessible and can be removed from the pocket. The first rod is pushed into a guide preferably present in the stowage box and in so ding draws at least a piece of the web material fastened thereto with it into the stowage box. The remainder of the web material of this pocket can either be pushed in by hand into the stowage box or can simply remain lying over the holding rod and loading rod. Then the following rod is moved in the same manner over the loading sliding carriage, i.e. over the holding rod and the loading rod, and is placed or pushed into the stowage box. Hence the next pocket is open and the object can be removed. In this way, gradually all the rods are removed from the upper guide and are stowed in the stowage box, wherein at least a portion of the web material is also held in the stowage box and the remaining web material lies possibly loosely on holding rod and loading rod.

After the complete unloading, the sliding carriage can then be pushed back in this form into the frame or container and be fixed and in this form the container or the frame is immediately ready to to receive new objects again, beginning with the first pocket. The first or last rod, depending on whether one is considering the loading or unloading process, can remain here in the upper guide. For loading, a corresponding object is then inserted into the first, already open pocket and the individual rods are then removed in reverse sequence again from the stowage box and are suspended into the upper guide, wherein the individual pockets are automatically completed and closed.

Expediently, the stowage box has a stowage flap at its lower end, articulated under the loading rod and able to be swivelled forward. This can be swivelled forward or flapped up in a simple manner and thus defines a receiving opening for the individual rods. The stowage flap can also be placed obliquely in the manner of a chute, so that one can simply allow the individual rods to drop from above into the stowage flap, on which they then slide into the stowage box. Preferably, however, lateral guide pieces are provided in the stowage box, if necessary in several stages one over another, for the ordered holding of the rods which are to be received therein. Hereby, if necessary it is possible in a simpler and easier way to take out the individual rods quickly from the stowage box in the correct sequence. As already mentioned, the loading sliding carriage is to be moveable as a unit into the frame and then fixable in a variably selectable position in the frame. Alternatively, of course, the holding rod can also be displaceable on the loading sliding carriage and variably fixable, when the loading sliding carriage only has a single fixed position or only roughly graduated fixable positions in the frame.

In the preferred embodiment, the loading rod and holding rod are connected with each other by lateral connecting members, so that the holding rod can be swivelled and folded around the loading rod serving here as an axis.

To accelerate and facilitate the loading and unloading, in particular in the case of the transporation of relatively heavy objects, the upper guides or guide tracks are to run offset downwards at their end facing the loading side. Thereby a course is described in which the upper guides or guide tracks run bent downwards and at a final end section parallel again to the remaining part of the guides or else inclined slightly upwards. These end sections of the guides then lie deeper than the actual part of the upper guide and it is then possible, for example, after a heavy object has been placed or inserted into a pocket, to firstly suspend the rod closing this pocket into the end section of the guide or guide tracks lying lower, wherein the lower end of the loops forming the pocket possibly still sits on the base or on the loading sliding carriage and supports the weight of the object contained in the pocket. Then the rod can be pushed up on the obliquely running section of the guide tracks, wherein also the pocket or the lower end section of the pocket is correspondingly raised. For this, one requires less force than for the direct suspension of the rods on the higher level of the main part of the upper guide tracks. If necessary, one must see to it here that the part of the objects resting at the bottom in the pocket slips relatively easily. Then the pocket hangs freely on the two rods, which run in the main part of the upper guide.

Expediently, all the rods carrying the web material, possibly also the holding rod and also the loading sliding carriage have at their opposite end or sides rollers which are guided in the corresponding guides or guide tracks, and namely so that the rollers can not slip out laterally from the guides.

In a variant of the invention already described, only a first rod runs in an upper guide, whilst all the other rods carrying the web material are arranged in guides running distinctly lower, wherein the holding rod is arranged parallel to the upper and to the lower rods on a level between them. This is the variant with the formation of short pockets in which, however, longer objects are held, which extend further upwards, so that they can be picked up by the holding rod arranged on an intermediate level and can be held in a more or less compressed position. For this, the device expediently has its own guide arranged in the frame, for the holding rod on the above-mentioned middle level.

In this variant, the individual pockets on loading and unloading or the objects held therein and projecting upwards are relatively easily accessible, so that here one does not require a loading sliding carriage, but one does require a stowage space for the rods and the web material of the pockets, when these are drawn out in succession forwards from their corresponding guides, in order to be able to empty the pockets in succession. For this, it is expedient if a corresponding receiving device is provided for such rods and the web material is provided on or in the transportation device. In the preferred form of embodiment of such a variant, the receiving device is formed from a free space with laterally arranged guide tracks to receive the rod ends, wherein the container and the guides or the web material lengths are selected so that this free space remains beneath the pockets in the container or frame.

Furthermore, in this variant of the invention it is expedient if several holding rods are provided, which are pushed respectively behind an object loaded into the device, so that respectively an object and a—preferably padded—holding rod are inserted alternately into the device. Optionally, a holding rod can also be respectively pushed in after a group of several objects. The holding rods can then keep the individual objects or groups thereof separate from each other, even if the pockets, compared with these objects, only have a very low height.

A further embodiment of the device according to the invention is particularly expedient and useful for preventing transportation damage, in which in addition to the holding rod, a braking or fixing device is also provided for the rods carrying the pockets. Hereby, the possibility of movement of the pockets which may be present and of the objects situated therein is restricted still further, because the pockets then are not only fixed in their central region by the holding rod but in addition also are fixed on the supporting rods of the individual pockets.

According to a variant, this braking/fixing device consists of an elongated plate arranged on a shaft or on a strip of an elastomer material, preferably of rubber, wherein the shaft preferably extends perpendicularly to the rods and approximately parallel to the guides for the rods and is swivellable about its longitudinal axis such that thereby the plate or the strip of elastomer material is able to be brought into engagement by one of its longitudinal edges with the rods, wherein this plate or its longitudinal edge is deformed accordingly on placing against the individual rods.

The shaft here can have a largely arbitrary cross-section and is rotatably mounted at its ends and preferably connected with a corresponding lever which permits the rotation of the shaft also against the resistance which possibly occurs.

According to another variant, a layer of a brake material, an elastomer material generally being preferred as brake material, is arranged on a track, which is swivellable on a series of swivel members on a plane containing the track itself. Preferably, the swivel plane is a vertical plane and the track is arranged above the rods and is pressed or drawn by one or more springs into a position in which the brake layer is raised from the rods.

Finally, a corresponding braking- or fixing device is preferably constructed according to the invention so that it is coupled with a closure mechanism of the loading sliding carriage or the closure flap or the insertion mechanism of the holding rod such that with the loading sliding carriage pushed in, the holding rod pushed in or the closure flap closed, it is automatically in engagement with the rods. Here, the device can be constructed in detail so that through the closure- or insertion process automatically also the braking device is actuated, or else the braking- or fixing device can be constructed so that it prevents a displacement of holding rod and loading sliding carriage into the desired position and/or prevents a closing of the closure flap, as long as the braking device has not been brought into engagement with the rods.

A braking device can also be provided specifically for the holding rods, wherein in the case of the use of several holding rods, this braking device, on supplying a further holding rod, is to be automatic or for example able to be released by the actuation of a foot pedal, so that rods already pushed in with the continued loading of the device together with the already loaded objects can move further into the container or frame.

Figure 2:
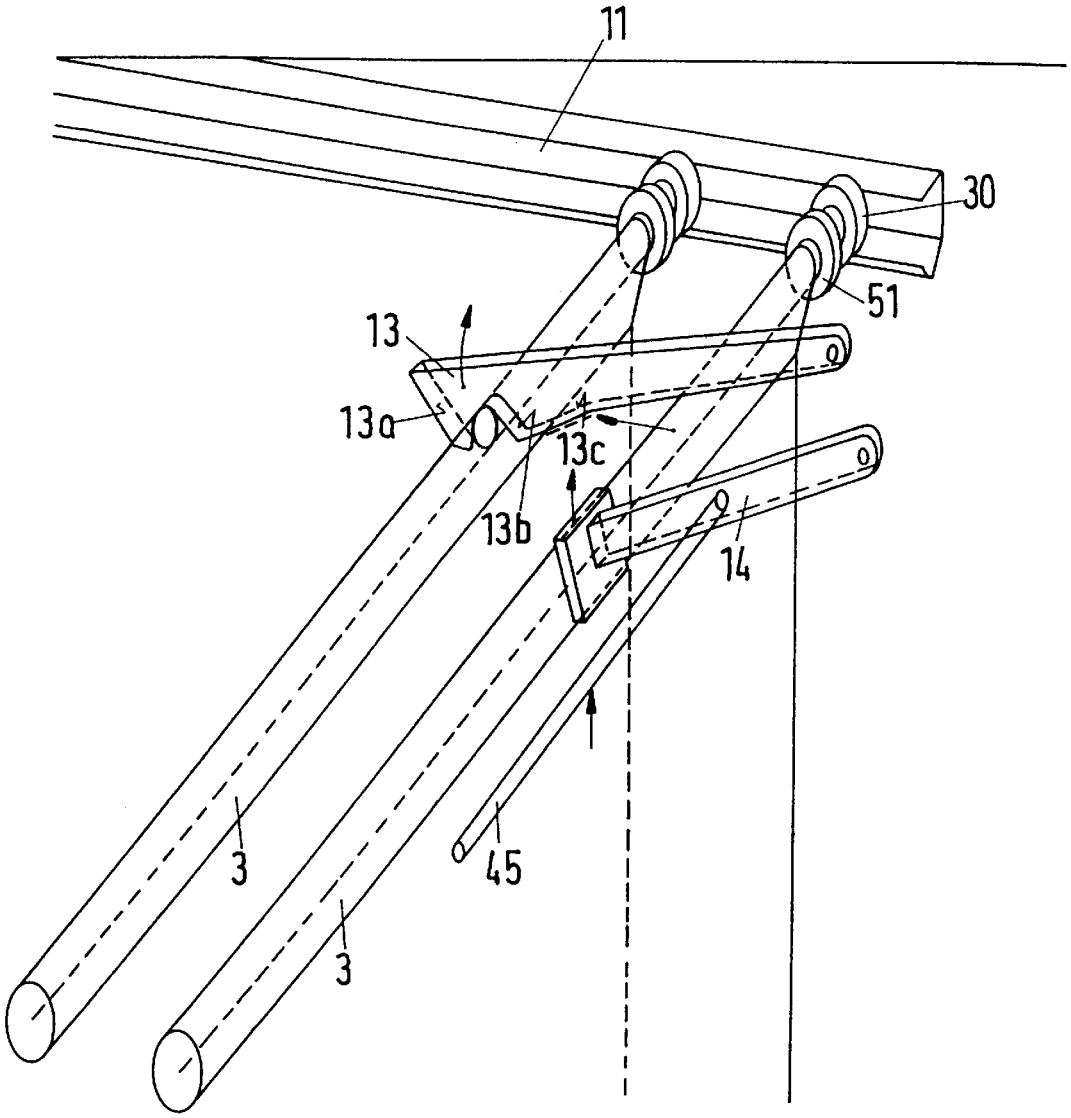
Figure 3:
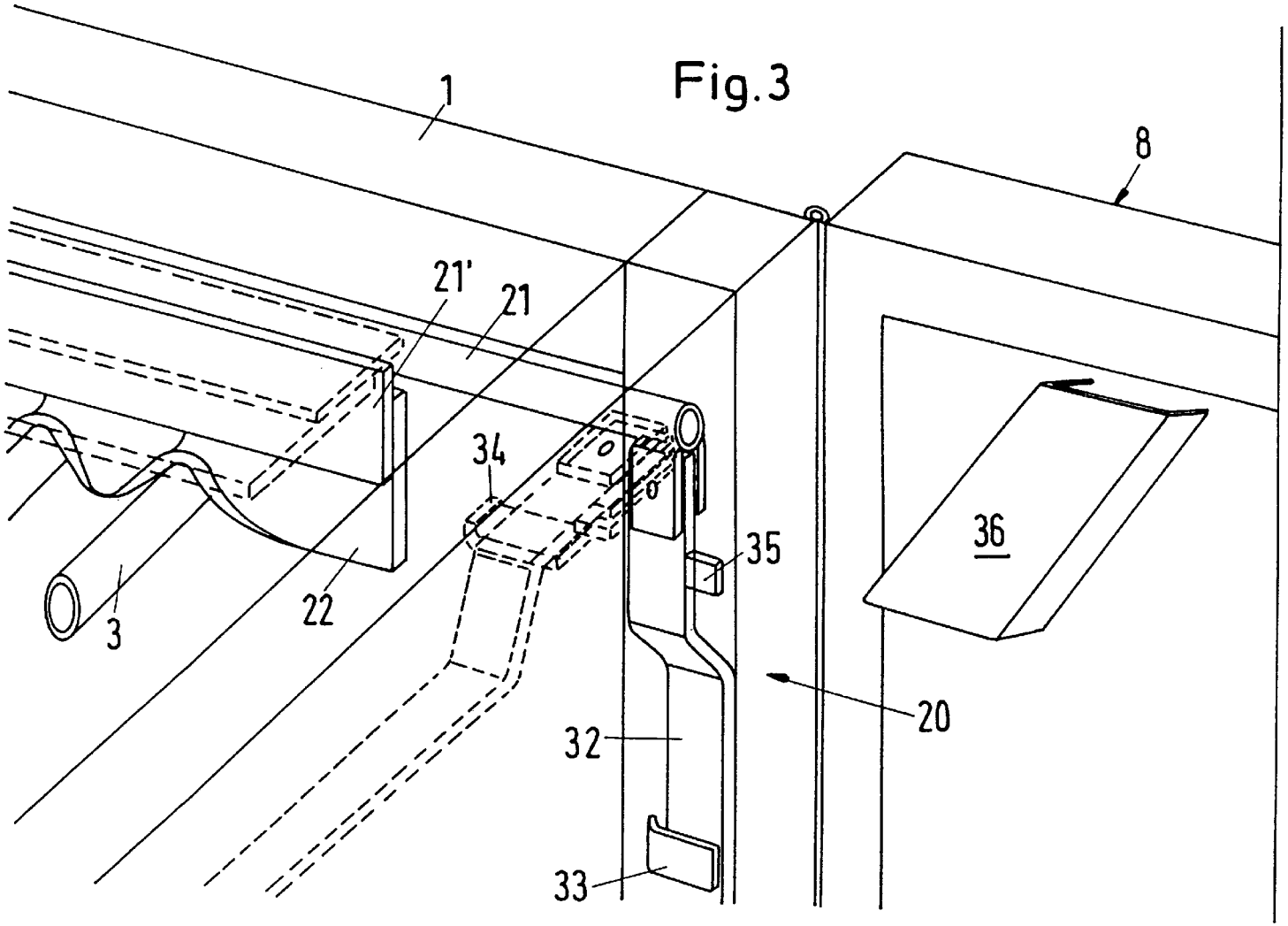
Figure 4:
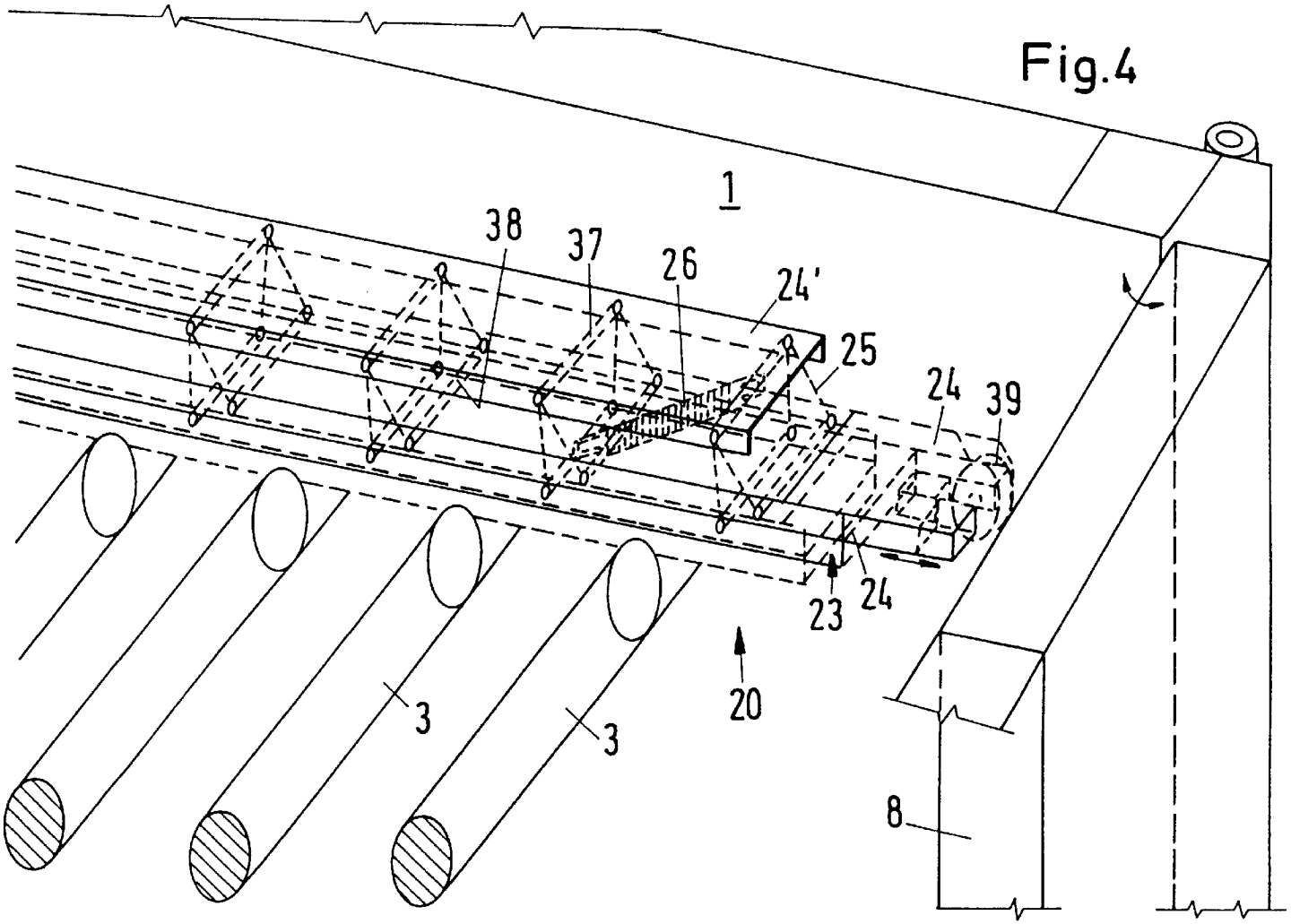
Figure 5:
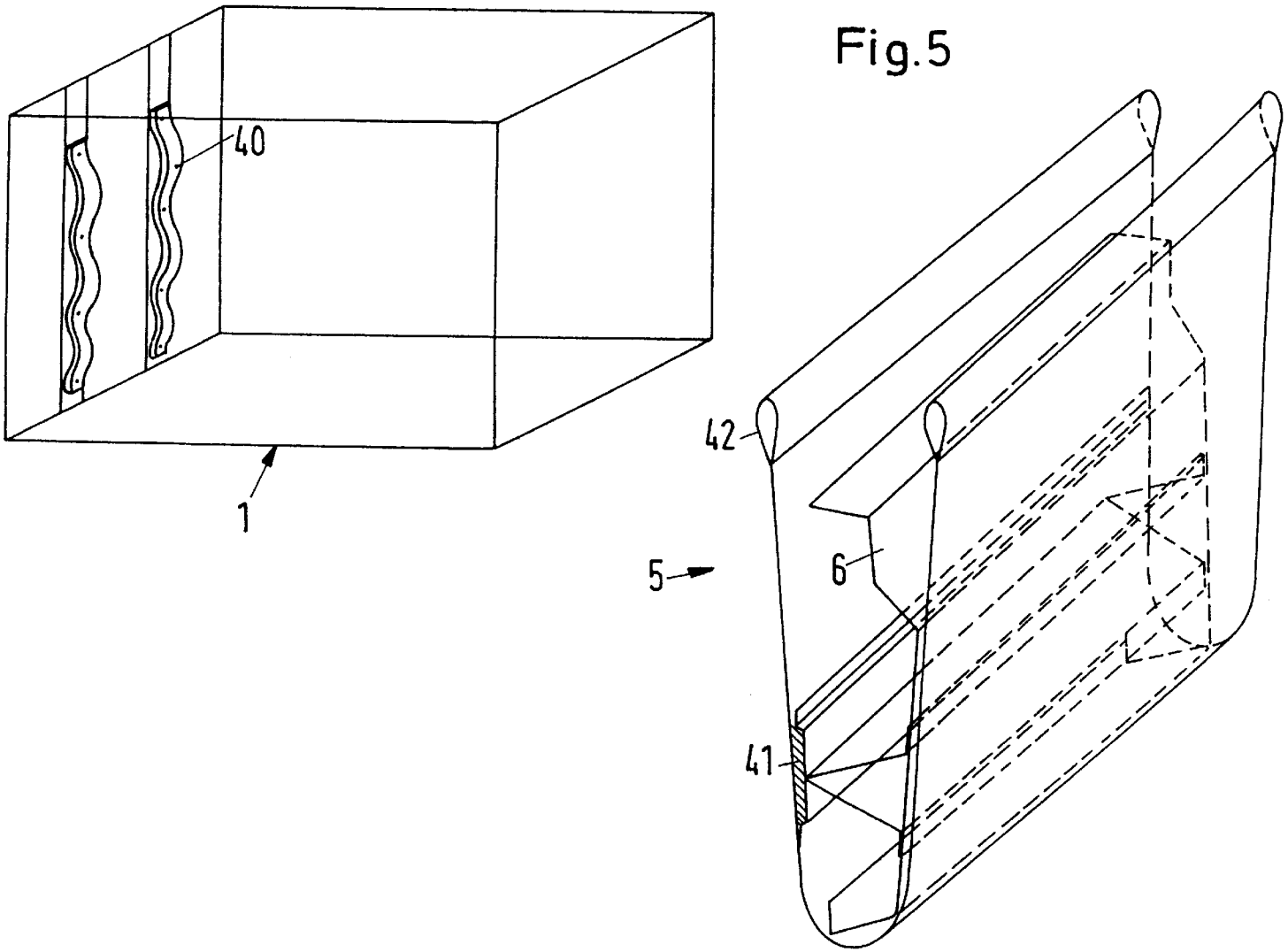
Figure 6:
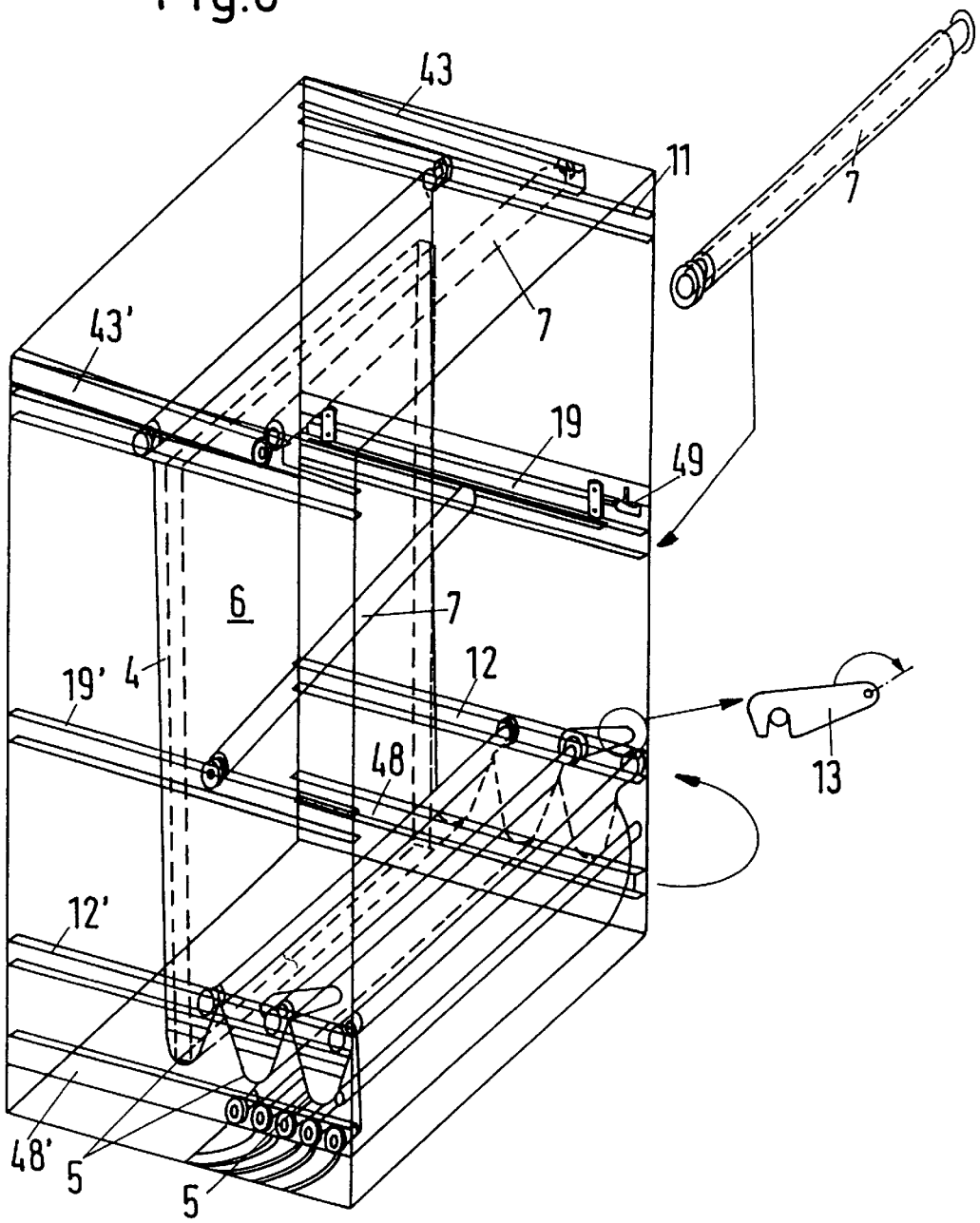
Figure 7:
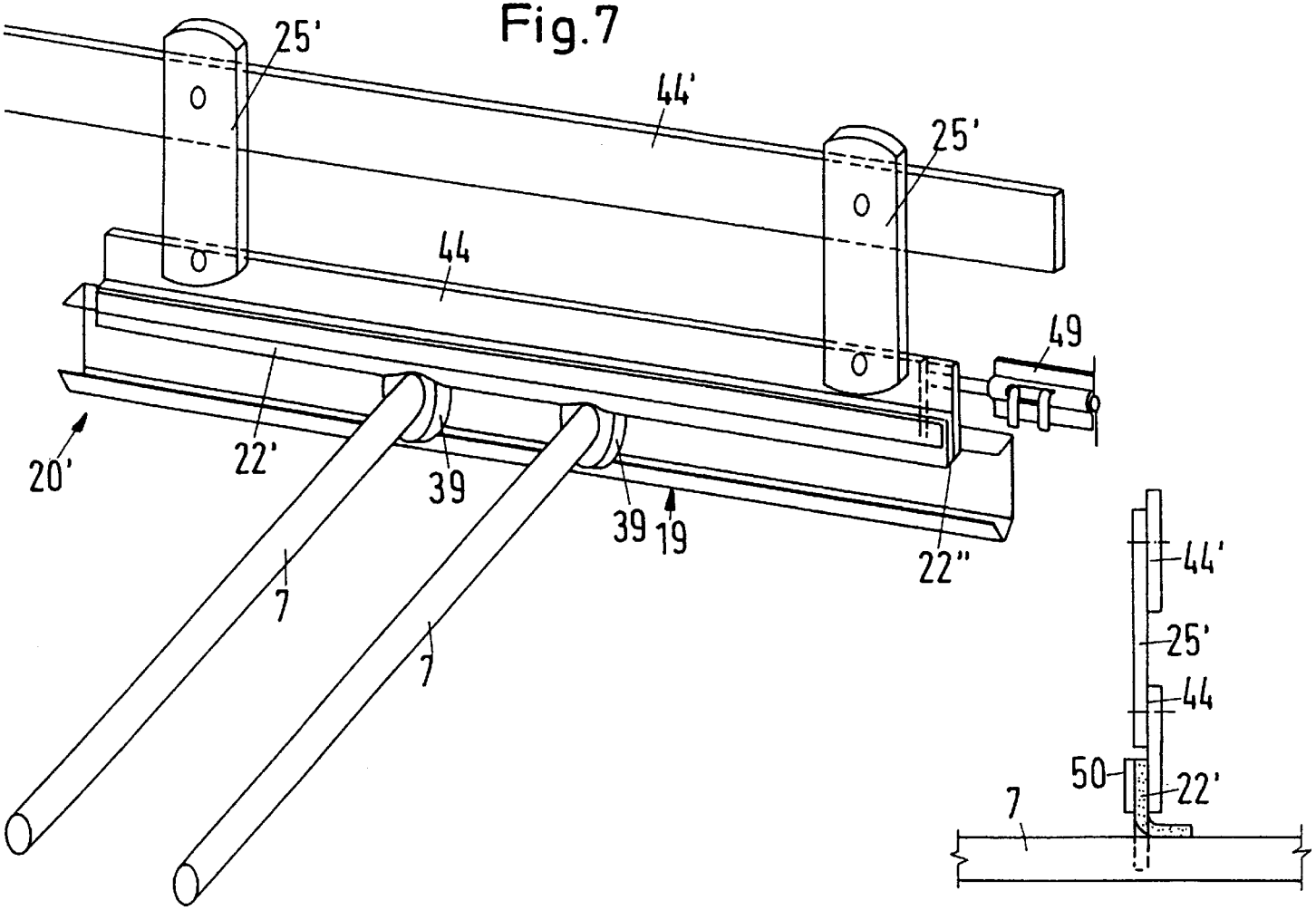

Further details of the developments described above and further advantages, features and possibilities of application of the present invention become clear with the aid of the following description of preferred embodiments and the associated figures, in which:

FIG. 1 shows an end section of a container with corresponding guides and a loading sliding carriage, FIG. 2 shows stopping- and holding members for the rods in a guide, FIG. 3 shows a variant of a braking- and fixing device, FIG. 4 shows a second variant of a braking- and fixing device, FIG. 5 shows the development of the frame or container and of the pockets with improved padding, FIG. 6 shows a variant of the invention with short pockets and separately insertable holding rods, and FIG. 7 shows a braking device for holding rods.

In FIG. 1 one can see a front section of a frame 1 with a loading sliding carriage 15. The walls 9,9' and the base 10 of the frame are likewise drawn in broken form, and also the upper guide tracks 11 and 11' for the rods 2 and 3. The frame 1, constructed here as a container, can therefore clearly extend further in the direction of the left-hand side in FIG. 1. For clarity, in addition the container 1 and also further parts have been drawn so as to be transparent, in order that details can be recognized better.

In the vicinity of the upper edge of the side walls 9,9', a pair of opposing guide tracks 11, 11' is secured, in which rollers 30 can run in a guided manner, which are respectively provided at the ends of rods 2 and 3 extending transversely between the guide tracks 11 and 11'. These rods 2 and 3 extend in turn through small holding loops at the upper ends of pockets 5 which are formed by larger, hanging loops of a web material, such as for example a foil of a plastic web or of a fabric. In FIG. 1 can see in the tracks 11, 11' only two rods 2 and 3, between which the web material 4 forms a pocket 5. Depending on the length of the frame or container 1, a greater or smaller number of identical pockets 5 can be suspended on a corresponding number of rods 2, 3. Here, any desired number of further rods 3 adjoin the first rod 2 of the first pocket 5, and the web material is preferably constructed so as to be continuous or extends respectively between two adjacent rods, so that as a whole one obtains a cohesive series or chain of such pockets 5. The second pocket 5, which joins on to the rod 3 held in the guide 11, 11', is illustrated in FIG. 1 in fact in opened state. In order to easily empty the pockets, in which piece goods, such as for example body parts, glass plates or other objects can be arranged, and also to be able to load them, an unloading sliding carriage 15 is provided. For this, a rod 3 of a pocket 5 is removed completely from the guide 11 or 11' over the obliquely running offset section 11*a* and the horizontal end section 11*b*, wherein the end section 11*b* still has a stop 11*c* projecting from below, which prevents a slipping out or falling out of the rod 3. The corresponding roller 30 must be lifted away over this stop or shoulder 11*c*. The loading sliding carriage has an approximately trapezoidal shape in cross-section, wherein the upper face of the loading sliding carriage is defined by the holding rod 7 facing the container and the loading rod 16 facing away from the container. Beneath the holding rod 7 and loading rod 16, the loading sliding carriage 15 has a free space, which serves as stowage space for rods 3 and web material 4. On its front face lying to the right in FIG. 1, the loading sliding carriage 15 additionally has a stowage flap 18, which has the form of a chute plate or baffle plate and consists of a sheet metal plate extending transversely over the loading sliding carriage 15 and two lateral metal sheets, which have approximately the shape of a sector of a circle and permit a folding up of the stowage flap 18 about an angle between typically 30° and 60°.

To open a pocket 5, the rod 3 is then removed from the section 11*b* of the guide tracks 11, 11' and deposited immediately in front of the stowage flap in the stowage box 17. Here, the web material 4 of one side of the pocket 5 lies over the holding rod 7 and the loading rod 16, and extends up to the just deposited rod 3. The longitudinal sections L1, L2 and L3 of the web material between the lowest point of the pocket 5 and the rod 3 correspond here to the overall length L of the pocket side which is still able to be seen on the left-hand side.

The loading sliding carriage 15 can also have an additional transverse rod in its lower region, which lies externally against the lower rim of a pocket 5, when the latter is opened or is in the opened state. Not illustrated in FIG. 1 are optionally present lateral guide tracks in the stowage box, into which the individual rods 3 can be pushed. Such guide tracks can be arranged one over another in several stages, in order to be able to fully utilize the volume of the stowage box. After the pocket 5 has been unloaded, the rod 3 can then be pushed in a corresponding guide or possibly also without a guide as far as possible into the stowage box 17 and also the web material 4 suspended thereon is pushed after as smoothly as possible or is deposited in the stowage box 17. Of course, if required, this web material can also remain on the stowage box, as long as only the rod 3 itself is pushed as far as possible into the stowage box.

The emptying of the next pocket then follows in a completely analogous manner, i.e. the next rod 3 is removed via the sections 11*a*, 11*b* from the guide tracks 11, 11' and via holding rod 7 and loading rod 16, possibly also via the web material of earlier pockets resting thereon, is deposited and the rod 3 is then in turn pushed as far as possible into the stowage box. This takes place in succession with all the rods 3, wherein a corresponding transportation device typically has approximately twenty such rods 3 and pockets 5. The last rod 2 can remain in the container 1. As can be additionally seen in FIG. 1, the pockets 5 can have closure bands 46 on the end face, which can be fastened for example by a burred closure on the edges of the pockets 5 on the end face on the web material 4.

During the unloading process and to open the individual pockets, the respectively following rods are held securely in their place by stopping parts 14 and holding parts 13. The two stopping parts 14 are suspended articulately at their rear end and have at their front end a stop plate coming into engagement with the rods 3 or with the corresponding holding loop of the pocket. In order to release the corresponding rod 3, the stopping parts 14 must be raised, so that the rod 3 can be moved away beneath the stopping parts to the sections 11*a* and 11*b* of the guide tracks 11, 11'. Here, at the same time also the holding parts 13 can be raised, so that also the next rod 3 can be moved further and is then held in the unloading or loading position by the stopping parts 14.

In this way, the individual pockets 5 are opened in succession and the objects situated therein, which are not illustratted in FIG. 1, can be removed accordingly in succession from the individual pockets 5. Here, gradually, the stowage box 17 is filled with the rods 3 and with the web material 4 lying therebetween or at least with parts of the web material. When all the pockets 5 have been emptied, the stowage box, which is guided with lateral rollers 30 in lower guide tracks 27,27', is pushed into the container 1 again, wherein an elastically prestressed detent cam 28 is raised by means of a foot pedal 47 and after pushing into the container 1 is arrested in one of the detent sites 29 on the base 10 of the container 1. The container 1 can then be transported again to a different site, in order to receive objects again in the corresponding pockets, which are then transported again to their destination.

On loading, the process described above runs in the reverse sequence. Firstly, by means of the foot pedal 47 the detent cam 28 is released from the detent site 29 and the sliding carraige 15 is moved out from the container 1 approximately so far that the front holding rod 7 lies approximately in the plane of the front of the container 1, as is illustrated in FIG. 1. The last rod 2 on unloading of the transportation device, which rod 2 is now the first rod of the first pocket 5, can be either still in the position illustrated in FIG. 1 in the holding parts 13 or else at the stopping parts 14, however it could optionally also be stowed in the stowage box 17. The stowage flap 18 opens automatically on drawing out of the sliding carriage 15, as is further described later. Then if necessary the rod 2 is removed from the stowage box and is inserted or pushed into the guide tracks 11, wherein it comes into engagement with the underside of the stopping parts 14 and in so doing these are automatically raised until they drop again, after the rod 2 has passed the stopping parts 14. Expediently, the stopping parts 14 have stops which limit their swivelling movement upwards and downwards, in which of course the swivelling movement is sufficient to allow the rods 2, 3 to pass.

When the first rod 2 is in the position behind the stop parts 14 or is engaged into the recess of the holding parts 13, the first pocket is opened, because the web material 4 hangs down from the rod 2 and, if this web material is stowed in the stowage box 17, it is drawn out if necessary and placed over the holding rod 7, so that with the formation of the first open pocket, it drops down in a similar manner to the sections L and L1 of the open pocket of FIG. 1. In this state, the respective object, e.g. a sheet metal plate or a body part, can be placed into the pocket 5. Then the next rod 3 is removed from the stowage box 17, is lifted and with its rollers 30 on the end face is suspended over the stop elements 11*c* in the section 11*b* of the guides 11, 11'. Then the rod is pushed upwards with its rollers along the obliquely running section 11*a* of the guide tracks, wherein again the stopping parts 14 are lifted and the preceding rod 2 or 3 is shifted further, whilst the newly placed rod is held behind the stopping parts 14 or engages with the holding parts 13. In this state, the next pocket 5 is free for loading, is loaded accordingly and the next rod is suspended into the section 11*b* of the guide tracks 11, 11' and so on. On placement of further rods, always a previously already placed rod is freed from the holding parts 13 and is moved further back in the guide tracks 11 11'.

The stowage flap 18 has at its lower end a lever which is angled forwards, with a roller at its free end. These serve to automatically close the stowage flap on introduction of the sliding carriage into the frame 1, because then the roller of this lever enters into engagement with the base edge of the frame or container, is thereby lifted and swivelled about the swivel axis of the stowage flap, wherein the stowage flap 18 which is connected with the lever is likewise swivelled and hence closed. Vice versa, the stowage flap opens automatically due to gravity and the relative arrangement of the stowage flap 18 to its swivel axis, when the sliding carriage is moved out from the container 1 and in so doing the roller of the lever slides downwards over the lower container edge.

In FIG. 2 the holding parts 13 and stopping parts 14 are illustrated again in further detail. In addition, one can see alongside the rollers 30, which run in a guide track 11 bent in a C-shape in cross-section and are thus secured against slipping out from the guide track 11, also spacers or buffers 51 arranged outside the tracks and adjacent thereto, which have a somewhat greater diameter than the rollers 30 and thus prevent a contact of adjacent rollers. As can be seen, the two adjacent stopping parts 14, of which here of course only one is illustrated, are connected with each other by a transverse bar 45, so that it is possible with a simple handle, by raising the transverse bar 45, to lift both stopping parts 14 at the same time. The holding parts 13 are automatically lifted toward the rear on displacement of the rod 3, because the next rod 3 slides on the lower oblique surface of the holding parts 13 and lifts them. Also the stopping parts are automatically lifted when the rods are pushed into the device, however on unloading of the device they must be lifted on the transverse bar 45, in order to be able to draw out the rod 3 forward from the guide tracks 11.

By means of additional bars or other auxiliary mechanical arrangements, the stopping parts can also be coupled with the holding parts 13, in order to also free the rod held by the holding parts 13 with active lifting of the stopping parts 14, possibly also with a small delay with respect to the stopping parts 14. The holding parts 13 have at their free end an oblique surface 13*a* and in the detent depression an oblique surface 13*b* inclined in the same direction. These oblique surfaces allow the rods 3, 2 to be able to slide through on unloading from the rear to the front under the holding parts 13, without these having to be lifted by action from the exterior, however the rods are prevented at the latest at the stopping parts 14 from a further outward movement. Vice versa, on loading, the rods 3 can pass the stopping part 14, however are held secure in the detent depression of the holding parts 13 and are prevented from a further inward movement, until the next rod 3 picks up the oblique surface 13*c* and thereby frees the rod 3 held in the detent depression, in order to then assume its place itself.

After all the pockets, optionally also only a portion of the pockets, have been loaded and the objects are to be transported to a different location, the sliding carriage 15 is pushed into the container 1 again. In so doing, the holding rod 7 comes into contact with the respectively last loaded pocket, it not being an intrusion if for example with an incompletely loaded device there are still a few layers of web material 4 on the holding rod 7. As can be seen in addition, the loading sliding carriage can be engaged on the detent points 29 in various positions in longitudinal direction of the container 1, wherein here the detent points are only indicated diagrammatically at five points, however can extend more or less over the entire length of the container 1. Thereby it is possible, independently of the respective loading state of the device and independently of the thickness of the respective objects which are held in the pockets, to always push the loading sliding carriage 15 into the container 1 so far that the loading rod 7 presses with a certain force against the last pocket 5 and thereby all remaining pockets 5 are correspondingly compressed, wherein the pressure force of the loading sliding carriage 15 is of course kept so low that in no way can damage occur to the objects 6 by the compressing in the pockets 5.

Alternatively, when the space in the container is substantially completely taken up by the objects 6 and pockets 5, the holding rod 7 can be swivelled upwards over the loading rod 16, downwards again into the position illustrated in dotted lines in FIG. 1. In this position, the loading rod 16 undertakes the function of the holding rod 7 and is brought into abutment or holding engagement with the last pocket on introduction of the sliding carriage 15. In this way it is always ensured that the pockets can not swing, or only to a small extent, in the container or frame 1, so that even on transportation in rocking lorries, damage to the objects 6 held in the pocket 5 is largely ruled out.

In addition, preferably also the individual supporting rods 2, 3 of the pockets 5 are fixed by means of a corresponding brake device 20. An example embodiment of this is illustrated in FIG. 3. In FIG. 3 one can see the brake device 20 which consists of a shaft 21, a metal plate 21' firmly connected with the shaft 21, and a rubber plate or a rubber strip 22 fastend to the metal plate 21'. The shaft 21 can be turned to and fro by means of a lever 32 through 90° about its longitudinal axis. Here, in dotted lines, a position is drawn of the lever 32 and of the rubber plate 22 fastened to the shaft, in which the brake device 20 is out of engagement with the rods 3. The fixing position is illustrated by solid lines. The brake lever 32 can be suspended in the released position of the brake device 20 behind a hook 34, which is fastened at its upper, transversely running frame part of the frame 1. When the brake is situated in the fixing position, as is drawn by solid lines, then the brake lever 32 is held secure behind a hook 33 which is fastened to a vertical spar of the frame 1. In so doing, the shaft 21 is swivelled with the parts fastened thereto through 90° from the position drawn in dotted lines, wherein the edge of the rubber strip or rubber plate 22 comes into engagement with the rods 3 and bends owing to its elasticity and lies in an arc shape around the individual rods 3. Hereby, the individual rods 3 are held secure in their position. Optionally, instead of the rubber strip or rubber plate 22, one can also use another, preferably elastomer material, wherein such a strip can also have recesses in predetermined spacings to receive the rods 3 or else can have a predetermined continuous corrugated pattern, wherein the rods 3 then, on bringing such a strip into engagement with the rods, slide into the corresponding recesses or depressions of the corrugated pattern. The variant with a continuous straight rubber strip 22, however, has the advantage that the spacings of the individual rods are thereby not fixed and all rods are held in the position which they actually assume after complete loading.

In addition to the swinging of the individual pockets 5, thereby also a slipping of the upper rods 2, 3 is prevented, so that the objects 6 are also held securely in the pockets 5 in the case of a very rough transportation.

Furthermore, in FIG. 3 in addition a few further details can be seen, which prevent a closure of the container 1 by means of the laterally articulated closure flap 8, unless the brake device is in the solidly drawn fixing position. It is to be understood that for loading and unloading the device, the brake device is released and the brake lever is situated in the position drawn in dotted lines behind the hook 34. As can be seen, however, the brake lever 32 has a slightly forward projecting cam 35 and on the inner face of the closure flap 8 in addition a cam plate 36 is arranged. On attempting to close the closure flap 8, when the brake lever is in the position drawn in dotted lines, the cam 35 automatically comes into engagement with the cam plate 36 and prevents the complete closure of the closure flap 8. This reminds the operator, if necessary, that firstly the brake lever 32 must be brought into the fixing position behind the hook 33, wherein in this position the closing of the closure flap 8 is possible, because then the cam plate 36, which is likewise mounted projecting on the inner face of the closure flap, can be moved past the cam 35 and also the remaining parts of the brake lever 32.

Another variant of a brake device is illustrated in FIG. 4. In the case of the example embodiment of FIG. 4, a plate 23 of a rubber elastic material or elastomer material, which has good braking qualities for the individual rods 3, is secured to the underside of a track 24 which is suspended in a rocking manner. The track 24 has a U-shaped cross-section and is secured by means of connecting members 25 which, for example, may have the form of individual bars or else sheet metal plates extending transversely over the track, on an upper track 24' which in turn is secured in the frame 1, preferably on a cover plate thereof. The connecting members 25, as already mentioned, can consist of individual longitudinal and transverse bars or struts, however they can also be sheet metal plates which are flanged on their upper and lower end and thereby respectively comprise an oscillation bar 37 or 38 extending transversely through the shanks bent in a U-shape. On one or more pairs of adjacent connecting members 25, in the manner illustrated in FIG. 4, a spring 26 can be arranged, which connects an upper transverse bar 37 of one connecting member 25 with the lower transverse bar 38 of the adjacent connecting member 25 and which is dimensioned so that, owing to its spring tension, it lifts the lower track 24 with the brake plate 23 arranged thereon into the position drawn in solid lines. The front end of the track 24 is in turn provided with a pressure roller 39, which in the position drawn in solid lines projects beyond the plane of the front edge of the frame or of the container 1. This leads to the roller 39, on closing of the closure flap 8, automatically coming into engagement with the closure flap, thereby being pressed to the rear together with the track 24, wherein the track 24 is pressed with the brake plate 23 against the action of the spring 26 into the engagement position drawn in dotted lines. In this position, the brake plate 23 presses onto the surface of the individual rods 3 and holds these securely in their position.

FIG. 5 shows further steps to prevent transportation damage to the objects transported in the pockets 5. In FIG. 5 at the top left, the container or frame 1 is illustrated without components such as guide tracks and suspended pockets etc. On the rear wall of the container 1, in corrugated form, strips 40 of padding material are fastened, which on bringing a holding rod up to the last filled pocket, catch the first pocket 5 in this row of pockets in an end position and thus form a softly padded abutment. The convexities owing to the corrugated shape of the padding material 40 can yield here in the direction of the rear wall.

As can be seen bottom right in FIG. 5, the pockets are also themselves provided with corresponding padding strips 41, which are preferably arranged at critical points where possibly sharp-edged sections of the objects 6 touch the inner wall of the pockets 5. As with such transportation devices often large numbers of identical objects are transported, it is often expedient to use pockets 5 specifically coordinated with the objects 6 to be transported and adapted accordingly, which can then have corresponding padding material 41 at quite specific sites. Of course, it is also possible to distribute padding elements or padding strips uniformly on the outer or inner face of the individual pocket, wherein of course care is to be taken that these paddings do not take up too much volume, because then the stowing of the web material 4 is substantially more costly and more difficult. In addition, one can also see clearly in FIG. 5 the suspension loops 42 constructed at the upper end of the pocket, through which the rods 2 or 3 extend. It is to be understood that the pocket 5, proceeding from each of the two loops 42, can be continued as desired with further adjoining pockets 5. Alternatively, of course, other suspension possibilities of the individual pockets are conceivable. For example, the upper ends of the web material of the individual pockets could be placed into a holding section and clamped firmly therein, wherein the holding section can be an additional part secured to the rods 2, 3 or else the rods themselves are constructed as corresponding section pieces.

In FIG. 6 a further embodiment of the invention is illustrated, in which the individual pockets 5', compared with the objects 6 held therein, have only a very small height. Actually, only the first rod 2 runs in an upper guide and forms a wall of a pocket of the web material 4, extending substantially over the entire height of the transportation device. The next rods 3, however, are guided in guide tracks 12,12' lying substantially deeper, so that the second wall of the first pocket and the following pockets 5' all together are substantially lower or shorter. On the other hand, one can seen that an object 6, illustrated by way of example, which is held in the first pocket, extends over a large part of the height of the container 1. It is to be understood that this object must be prevented from tipping out from the pocket. For this, a holding rod 7 is provided, which is guided on a central vertical level in guide tracks 19, 19'. This holding rod 7 can be lined with a padding material and is pressed in the guide 19, 19' against the object 6. Preferably, the holding rods 7 have approximately the same diameter as the lower rods 3 with the loops 42 lying around.

In this variant, no loading sliding carriage with stowage box is provided, but rather expediently in addition lower guide tracks 48, 48' are provided, which still extend beneath the lower edge of the individual pockets 5'. Beneath the pockets 5' therefore a free space is further provided, in which the individual rods 3 can be held with the empty pockets 5', wherein the web material 4 of the pockets 5' can also readily lie on the base of the container 1.

The rods 3 of the empty pockets 5' are then therefore removed in succession from the lower guides 48, 48' and pushed into the lower guides 12, 12' lying thereabove. The object 6 is then inserted into such a pocket and is swivelled to the rear against the wall of the first pocket or in the case of the lower pockets against the holding rod 7 previously introduced into the guides 19, 19'. In the lower region then the objects, preferably plate-shaped objects 6, are held spaced apart by the individual rods 3 and in the central region holding rods 7 produce the desired distance between the objects 6, so that these can not touch each other and damage each other. Following each object 6, a new holding rod 7 is introduced again into the guides 19, 19'. The holding rods 7 are stored in turn in an upper guide path 43, 43' unless they are required in the central guide tracks 19, 19'. This upper guide path 43, 43' runs inclined slightly forward, so that the individual holding rods 7, with the container 1 aligned vertically, roll foward against a stop not illustrated here, so that they can be easily removed from the front region of the container 1. In so doing, respectively, a holding rod 7 is pushed into the guides 19, 19' behind an object 6 held in one of the pockets 5' and extending upwards.

In FIG. 7 in this connection in addition a braking- and fixing device 20' is illustrated which has also been shown more generally in FIG. 6, and which is coordinated specifically to this variant. The concern here in particular is that on loading the device one of the objects 6 does not possibly tilt forward, simply pressing the respective holding rod 7 from its guide 19, 19'. For this purpose, a braking and fixing device is provided, which has certain factors in common with the brake device suspended in a rocking manner, illustrated in FIG. 4. Also in the case of the brake device 20' illustrated in FIG. 7, an upper track 44' is fastened rigidly to the container, e.g. on the lateral container wall 9 and a lower track 44 is suspended in an oscillating manner parallel to the upper track 44' and via connecting members 25'. Furthermore, on the lower track 44 in turn a strip or an elongated plate 22' of a rubber elastic material is fastened, the free edge of which can come into engagement with the upper face of the individual holding rods 7. At the front end of the track 44 in addition an adjustable stop 49 is provided, through which it is to be ensured that the lower track 44, on swivelling about the axes of the connecting members 25', is not able to be moved beyond the lower dead centre which marks the lowest position of the track 44' and of the rubber strip 22'. On the other hand, the track 44 can be moved by the stop 49 away to the front, i.e. to the left in FIG. 7, and upwards. If a new holding rod 7 is now pushed with its roller 39 into the track 19, and if in so doing the track 44 or the rubber strip 22' is situated close to its lowest possible position, then the rod 7 strikes against the end face 22" of the rubber strip 22' and in so doing moves it to the left, wherein the two connecting members 25' swivel about their upper axis on the track 44' and thereby lift the lower track 44 with the rubber strip 22'. The rod 7 then slides through under the lower edge of the strip 22' until it comes into abutment with the object 6 which is to be held and is pressed against slightly further, in order to firmly press in abutment against each other the entire series of objects and rods which are arranged alternately one behind the other. The elastic restoring forces of the entire system then have the tendency to press the individual rods with the objects back again somewhat, wherein, however, the upper face of the rods touches the lower edge of the rubber strip 22' and takes this back with it somewhat to the rear. In so doing, the track 44 must automatically drop with the rubber strip 22' and thus comes into increasingly greater contact with the rods 7, so that the strip 22' at its lower edge buckles slightly elastically and finally, when the track 44 strikes against the stop 49, secures all rods 7 uniformly well. The rubber strip 22' here is preferably secured on the track 44 so as to be exchangeable by means of a rear holding plate 50.

In addition, the stop 49, as already indicated in FIG. 7, has two different fixing positions, namely the one normal operation position just described, and a release position in which the stop is moved further forward and holds the track 44 in a slightly raised state, so that the lower edge of the rubber strip 22' is out of engagement with the holding rods 7. This position is preferably set for the unloading of the device, when holding rods 7 are to be removed to the front from the guide tracks 19. The stop here can also be movable elastically back into its normal position, so that it is always only moved from the holding rods for the moment of drawing forward of one or more holding rods 7 with objects arranged therebetween, and then comes back into engagement therewith again. The removed holding rods 7 are then pushed into the upper guides 43, 43' in succession, whilst the lower rods 3, which carry the individual pockets 5', are pushed into the lower guides 48, 48'.

The braking devices and also the holding- and stopping parts 13, 14 can also be selectively equipped with a foot lever mechanism, so that the persons who undertake the loading and unloading, on actuating the same element, have their hands free for the removal or suspension of the rods 3. The said elements are preferably prestressed here in holding engagement and are only released by actuation of the foot lever.

What is claimed is:

1. A transportable transportation device for carrying piece goods, the transportable device consisting of a transportable frame (1) with an upper guide for at least one first rod (2) held and guided on the upper guide, and with further rods (3) which likewise extend on one of said upper guide, or a parallel guide parallel to the upper guide, at a distance beneath the upper guide substantially parallel to the first rod (2), wherein the rods carry a web material (4) in the form of loops acting as receiving pockets (5) for piece goods (6) being loaded and unloaded on said transportable device, wherein at least one holding rod (7) is provided which is aligned parallel to the remaining rods (2,3) and which is displaceable beneath the upper guide in the direction of the receiving pockets (5) and in an abutment position against a last of these pockets (5) along the rods (2,3) or an object (6) held in said last pocket, said holding rod being fixable in said abutment position, such that said receiving pockets loaded with piece goods are pushed toward each other to greatly reduce swinging movement of the pockets during relocation of the entire transportation device.

2. A transportation device according to claim 1, wherein the upper and a parallel lower guide, when present, comprise a pair of upper guide tracks (11, 11') and a pair of lower guide tracks (12, 12') respectively, arranged laterally in the frame (1), said guide tracks being arranged to have a piece goods loading side.

3. A transportation device according to claim 2, wherein the upper guide tracks (11, 11') run offset downwards at their loading side.

4. A transportation device according to claim 3 wherein several holding rods (7) are provided, one of which is arranged between adjacent objects (6) or between groups of objects (6) on an intermediate level between upper and lower guides.

5. A transportation device according to claim 3, wherein the frame (1) additionally has a receiving arrangement, at a distance beneath the lower guide, for rods (3) and web material (4) not in use.

6. A transportation device according to claim 5, wherein the receiving arrangement consists of a free space remaining beneath pockets (5) formed by the loops, with laterally arranged guide tracks to receive ends of the rods (3).

7. A transportation device according to claim 1, wherein the frame is provided on a charging side with a closure flap (8).

8. A transportation device according to claim 1, wherein the frame comprises side walls (9) on a base (10).

9. A transportation device according to claim 1, wherein the frame comprises side walls (9) on a base (10) and further comprises a cover to form a container enclosed by said base, sidewalls and cover.

10. A transportation device according to claim 1, wherein the holding rod (7) is lined with a padding material.

11. A transportation device according to claim 1, wherein at least one of a holding part (13) and a stopping part (14) are provided for holding the rods (2, 3) in the guides in at least one of a loading and unloading position.

12. A transportation device according to claim 11, wherein the loading sliding carriage (15) has a loading rod (16) arranged behind the holding rod (7), and that under the holding rod (7) and the loading rod (16) a stowage box (17) is provided for receiving rods (2,3) and the web material (4) arranged thereon.

13. A transportation device according to claim 12, characterized in that the stowage box (7) has a stowage flap (18) articulated on a lower end of said box under the loading rod and swivellable forward.

14. A transportation device according to claim 13, wherein stowage box (17) lateral guide parts are provided for the ordered holding of the rods (2,3).

15. A transportation device according to claim 12, wherein the holding rod (7) is swivellable about the loading rod (16).

16. The transportation device according to claim 15, wherein loading rod (16) has a sheathing of a padding material.

17. A transportation device according to claim 1, wherein the holding rod (7) is provided on a loading sliding carriage (15) which is movable into the frame.

18. A transportation device according to claim 17, wherein the loading sliding carriage (15) is moveable as a unit into the frame (1) and is able to be fixed in a variably selectable position in the frame (1).

19. A transportation device according to claim 17, wherein at least a portion of said first rod, said further rods and said holding rod (2, 3, 7) and loading sliding carriage (15) have rollers (30') guided in the respective guides.

20. A transportation device according to claim 1, wherein a first rod (2) runs in an upper guide, whilst all the other rods (3) carrying the web material (4) are guided in a guide running distinctly lower, and that the at least one holding rod (7) is arranged parallel to the upper (2) and the lower rods (3) at an intermediate level between rods (2) and (3).

21. A transportation device according to claim 20, wherein the holding rod (7) has its own guide (19, 19') in the frame (1).

22. A transportation device according to claim 21, wherein the guide (19, 19') for the holding rods extends substantially over an entire length of the frame (1).

23. A transportation device according to claim 2, wherein a braking and fixing device (20) is provided for the rods (2, 3) held in the guides.

24. A transportation device according to claim 23, wherein the braking and fixing device (20) consists of an elongated plate (22) of an elastomeric material, arranged on a shaft (21), wherein the shaft (21) extends perpendicularly to the rods (2, 3) and approximately parallel to the upper guide tracks (11, 11') and is swivellable about a longitudinal axis of the shaft (21) such that the plate (22) of elastomer material is able to be brought into engagement by one of longitudinal edges (22') of the plate with the rods (2, 3) with deformation.

25. A transportation device according to claim 23, wherein the braking and fixing device comprises a brake layer arranged in a track (24) which is swivellable on a series of swivel members (25) in a plane containing the track (24).

26. The transportation device according to claim 25, wherein the brake layer consists of an elastomeric material.

27. A transportation device according to claim 25, wherein track (24) is forced by a spring (26) into a position in which the brake layer made of elastomer material, is lifted from the rods (2, 3).

28. A transportation device according to claim 23, wherein the braking and fixing device (20) is coupled with at least one of a closure mechanism of a loading sliding carriage (15), a closure flap (8) and the holding rod (7) such that, with the loading sliding carriage (15) or holding rod pushed in or the closure flap (8) closed, the braking and fixing device is automatically engaged with the first and further rods (2, 3).

29. A transportation device according to claim 1, wherein the frame (1) is padded at a rear end.

30. The transportation device of claim 29, wherein the padding comprises corrugated strips curving into the device.

* * * * *

UNITED STATES PATENT AND TRADEMARK OFFICE

CERTIFICATE OF CORRECTION

PATENT NO. : 6,164,440
DATED : December 26, 2000
INVENTOR(S) : Theodorus J P M Van Bree It is certified that error appears in the above-identified patent and that said Letters Patent is hereby corrected as shown below:

Column 16,
Line 16, please change the dependency from 11 to 17.

Signed and Sealed this

Twenty-sixth Day of November, 2002

*Attest:*

*Attesting Officer*

JAMES E. ROGAN
*Director of the United States Patent and Trademark Office*